US012715638B2

(12) United States Patent
Singh et al.

(10) Patent No.: US 12,715,638 B2
(45) Date of Patent: Aug. 25, 2026

(54) LOADING ASSEMBLY FOR PACKAGING SYSTEM

(71) Applicants: SCI-TECH CENTRE, Mumbai (IN); ACG PAM PHARMA TECHNOLOGIES PVT LTD, Mumbai (IN)

(72) Inventors: Karan Singh, Mumbai (IN); Hans-Werner Bongers, Mumbai (IN); Sumit Waghmare, Mumbai (IN); Priyabrata Sahu, Mumbai (IN); Suryabansh Singh, Mumbai (IN)

( * ) Notice: Subject to any disclaimer, the term of this patent is extended or adjusted under 35 U.S.C. 154(b) by 0 days.

(21) Appl. No.: 18/844,989

(22) PCT Filed: Mar. 9, 2023

(86) PCT No.: PCT/IN2023/050224
§ 371 (c)(1),
(2) Date: Sep. 9, 2024

(87) PCT Pub. No.: WO2023/170709
PCT Pub. Date: Sep. 14, 2023

(65) Prior Publication Data

US 2025/0256877 A1 Aug. 14, 2025

(30) Foreign Application Priority Data

Mar. 9, 2022 (IN) ..... 202221012823

(51) Int. Cl.
*B65B 5/06* (2006.01)
*B65B 35/40* (2006.01)
(Continued)

(52) U.S. Cl.
CPC ..... *B65B 35/44* (2013.01); *B65B 5/06* (2013.01); *B65B 35/40* (2013.01); *B65B 43/52* (2013.01); *B65B 65/02* (2013.01); *B65B 2220/16* (2013.01)

(58) Field of Classification Search
USPC ..... 53/147
See application file for complete search history.

(56) References Cited

U.S. PATENT DOCUMENTS

2005/0166549 A1* 8/2005 Bongers ..... B65B 61/26 53/445
2016/0176560 A1* 6/2016 Aumann ..... B65B 59/005 53/473
2018/0222608 A1* 8/2018 Hutter ..... B65B 5/024

FOREIGN PATENT DOCUMENTS

EP 0465437 B1 8/1994

* cited by examiner

*Primary Examiner* — Chinyere J Rushing-Tucker
(74) *Attorney, Agent, or Firm* — Nitin Kaushik

(57) ABSTRACT

The present disclosure relates to a loading assembly including a cartoning section (100) for processing a plurality of cartons (114) and cartoning a plurality of blister leaflets (110) in the plurality of cartons (114) simultaneously. The cartoning section (100) includes a conveyor belt (106) for conveying the cartons (114) and the blister leaflets (110) thereon. Processing stations (116*a*, 116*b*, 116*c*, 116*d*, 116*e*, 116*f*, 116*g*) are located on the conveyor belt (106), each of which processes the plurality of cartons (114) and inserts the plurality of blister leaflets therein. Shuttles (104) carry at least one of a blister leaflet (110) and a carton (114). The shuttles (104) are guided on the conveyor belt (106) to pass through the plurality of processing stations for processing the plurality of cartons (114) and inserting the plurality of blister leaflets (110) into the plurality of cartons (114).

9 Claims, 6 Drawing Sheets

(51) Int. Cl.

| | |
|---|---|
| ***B65B 35/44*** | (2006.01) |
| ***B65B 43/52*** | (2006.01) |
| ***B65B 65/02*** | (2006.01) |

400

LOADING ASSEMBLY FOR PACKAGING SYSTEM

CROSS-REFERENCE TO RELATED APPLICATIONS

The application claims priority to Indian Patent Application number 202221012823, filed on Mar. 9, 2022, the entire contents of which are incorporated herein by reference.

TECHNICAL FIELD

The present disclosure relates generally to the field of the packaging industry, more particularly, the present disclosure relates to a loading assembly for a packaging system.

BACKGROUND

The packaging industry has been in place for a long and is segmented by product type, material type, and end-user industry. The demand for packaging is growing with the growth of population, increase in income levels, everchanging lifestyles, and growing economies. Further, the packaging industry is one of the strongest growing sectors worldwide. The manufacturers of packaging cartons have been working all this time to keep the workflow of the packaging industry consistent for most essential products like food and other consumer products, medical and pharmaceutical products, tissue and hygiene products, etc.

Generally, the packaging systems comprise blister leaflets and cartons as the most used packaging means and are manufactured using blister manufacturing and cartoning systems. The conventional blister manufacturing and cartoning systems process approximately three hundred cartons per minute, each carton having three blister leaflets. However, the conventional blister manufacturing and cartoning systems have two separate lines in a single assembly, for manufacturing blister leaflets, and cartoning the blister leaflets in the cartons so manufactured. This utilizes more space as individual stations involved in the manufacturing process and the packaging process is quite big. Further, such conventional systems require time, and as a system, more maintenance at the time of changeover.

Therefore, there is a requirement for a compact and high-speed loading assembly for the packaging system, which is easy to install and maintain, thereby having low maintenance costs and being more operator friendly.

SUMMARY

This summary is provided to introduce a selection of concepts, in a simplified format, that are further described in the detailed description of the invention. This summary is neither intended to identify key or essential inventive concepts of the invention and nor is it intended for determining the scope of the invention.

The present disclosure relates to a loading assembly for a packaging system. The loading assembly includes a cartoning section for processing a plurality of cartons and cartoning a plurality of blister leaflets in the plurality of cartons simultaneously. The cartoning section includes a conveyor belt adapted to convey the plurality of cartons and the plurality of blister leaflets thereon. A plurality of processing stations are located on the conveyor belt, each of the plurality of processing stations adapted to process the plurality of cartons and insert the plurality of blister leaflets into the plurality of cartons. A plurality of shuttles is adapted to carry at least one of a blister leaflet and a carton. The plurality of shuttles is adapted to be guided on the conveyor belt to pass through the plurality of processing stations for processing the plurality of cartons and inserting the plurality of blister leaflets into the plurality of cartons.

The present disclosure also relates to a loading assembly for a packaging system. The loading assembly includes a cartoning section for processing a plurality of cartons and cartoning a plurality of blister leaflets in the plurality of cartons simultaneously. The cartoning section includes a moveable platform adapted to convey the plurality of cartons and the plurality of blister leaflets thereon. A plurality of processing stations is located randomly on the moveable platform. Each of the plurality of processing stations is adapted to perform a preassigned task for processing the plurality of cartons and inserting the plurality of blister leaflets into the plurality of cartons. A plurality of shuttles is adapted to carry at least one of a blister leaflet and a carton. The plurality of shuttles is adapted to be guided on the conveyor belt to pass through the plurality of processing stations for inserting the plurality of blister leaflets into the carton and closing the carton thereafter.

The present disclosure further relates to a blister manufacturing and packaging system. The blister manufacturing and packaging system includes a blister manufacturing section adapted to manufacture a plurality of blister leaflets, and a cartoning section located downstream to the blister manufacturing section. The cartoning section is adapted to process a plurality of cartons and carton a plurality of blister leaflets in the plurality of cartons simultaneously. The cartoning section includes a conveyor belt adapted to convey the plurality of cartons and the plurality of blister leaflets thereon. A plurality of processing stations is located on the conveyor belt. Each of the plurality of processing stations is adapted to perform a preassigned task for processing the plurality of cartons and inserting the plurality of blister leaflets into the plurality of cartons. A plurality of shuttles is adapted to carry at least one of a blister leaflet and a carton. The plurality of shuttles is adapted to be guided on the conveyor belt to pass through the plurality of processing stations for inserting the plurality of blister leaflets into the carton and closing the carton thereafter.

The blister manufacturing and cartoning system disclosed herein includes a blister manufacturing section and the cartoning section which function simultaneously. This helps in providing a compact and high-speed blister manufacturing and cartoning system while producing the same orientation of blister leaflets and cartons as that of conventional cartoning systems. The cartoning section is easy to install and maintain due to its less complex nature, thereby having low maintenance costs and being more operator friendly.

To further clarify advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

Figure 1A:
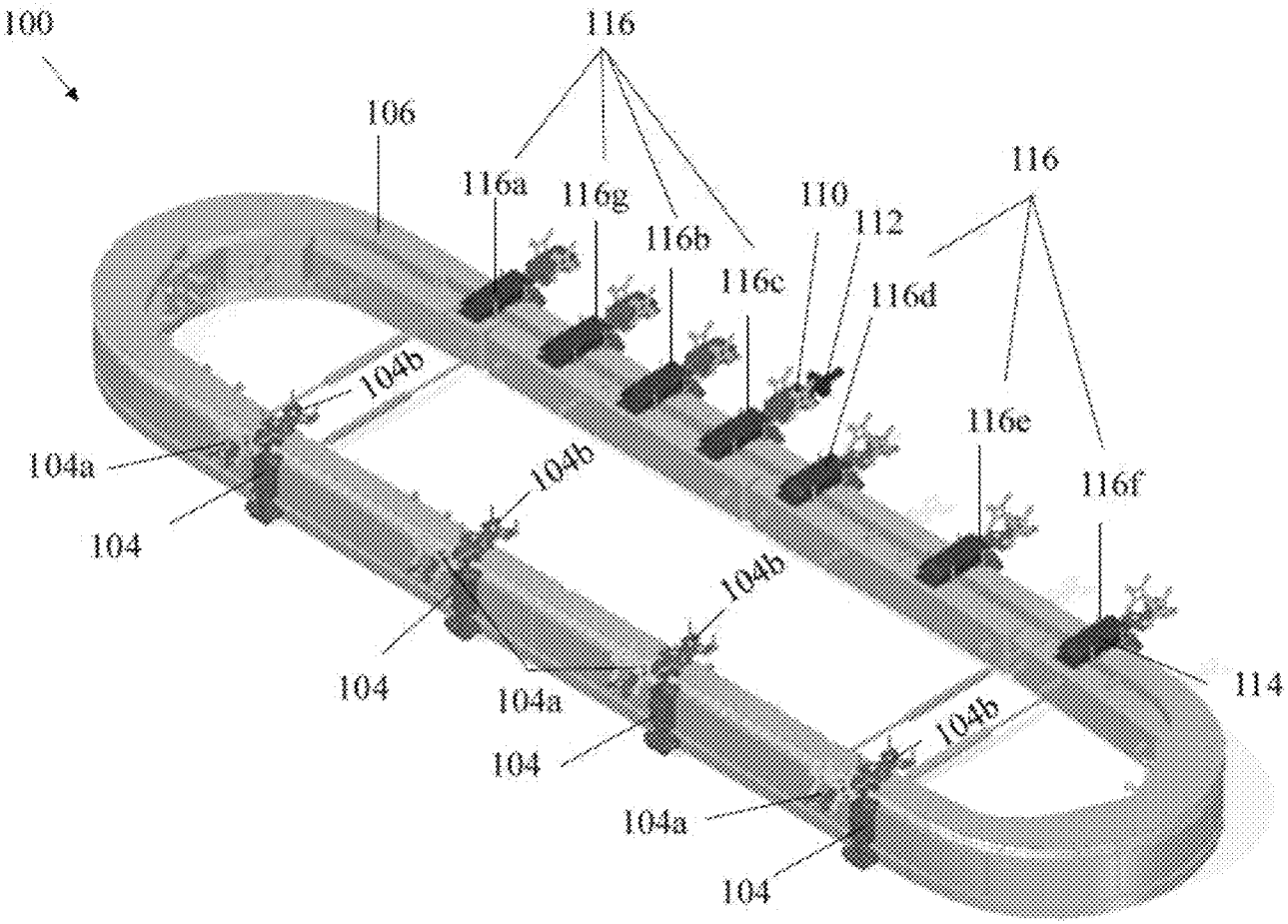
FIG. 1A illustrates a cartoning section with dual pocket shuttles, according to an embodiment of the present disclosure.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE EMBODIMENTS

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The system, methods, and examples provided herein are illustrative only and not intended to be limiting.

For example, the term "some" as used herein may be understood as "none" or "one" or "more than one" or "all." Therefore, the terms "none," "one," "more than one," "more than one, but not all" or "all" would fall under the definition of "some." It should be appreciated by a person skilled in the art that the terminology and structure employed herein is for describing, teaching, and illuminating some embodiments and their specific features and elements and therefore, should not be construed to limit, restrict or reduce the spirit and scope of the present disclosure in any way.

For example, any terms used herein such as, "includes," "comprises," "has," "consists," and similar grammatical variants do not specify an exact limitation or restriction, and certainly do not exclude the possible addition of one or more features or elements, unless otherwise stated. Further, such terms must not be taken to exclude the possible removal of one or more of the listed features and elements, unless otherwise stated, for example, by using the limiting language including, but not limited to, "must comprise" or "needs to include."

Whether or not a certain feature or element was limited to being used only once, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language including, but not limited to, "there needs to be one or more . . . " or "one or more elements is required."

Unless otherwise defined, all terms and especially any technical and/or scientific terms, used herein may be taken to have the same meaning as commonly understood by a person ordinarily skilled in the art.

Reference is made herein to some "embodiments." It should be understood that an embodiment is an example of a possible implementation of any features and/or elements of the present disclosure. Some embodiments have been described for the purpose of explaining one or more of the potential ways in which the specific features and/or elements of the proposed disclosure fulfil the requirements of uniqueness, utility, and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or other variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or in the context of more than one embodiment, or in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not necessarily be taken as limiting factors to the proposed disclosure.

Embodiments of the present invention will be described below in detail with reference to the accompanying drawings.

For the sake of clarity, the first digit of a reference numeral of each component of the present disclosure is indicative of the Figure number, in which the corresponding component is shown. For example, reference numerals starting with digit "1" are shown at least in FIG. 1. Similarly, reference numerals starting with digit "2" are shown at least in FIG. 2.

The present disclosure relates to a loading assembly for a packaging system. The loading assembly includes a blister manufacturing section and a cartoning section. The blister manufacturing section includes various stations, which are adapted to perform different functions related to the manufacturing of the blister leaflets. The stations in the blister manufacturing may be adapted to perform operations like heating, forming, feeding, sealing, embossing perforation, and punching of the blister leaflets. Once the blister manufacturing and sealing are complete, a blister sheet will be cut off into blister leaflets.

The plurality of blister leaflets so manufactured are required to be appropriately distributed based on the type of products contained therein. In one example, the distribution of the plurality of blister leaflets may be done by cartoning them based on the type of the product. The cartoning section is employed for cartoning of the plurality of blister leaflets and is located downstream to the blister manufacturing section. The plurality of blister leaflets is required to be transferred to the cartoning section for cartoning. Cartoning is the process of packaging the plurality of blister leaflets into separate cartons, based on the type of products. The plurality of blister leaflets is transferred to the cartoning section by a transfer unit (not shown). The transfer unit is located between the blister manufacturing system and the cartoning section. The transfer unit is adapted to transfer the plurality of blister leaflets from the blister manufacturing section to the cartoning section. The cartoning section is adapted to receive the plurality of blister leaflets from the transfer mechanism, and carton the plurality of blister leaflets simultaneously with the manufacturing of the plurality of blister leaflets in the blister manufacturing section.

FIG. 1A depicts a cartoning section 100, which includes a plurality of processing stations 116*a*, 116*b*, 116*c*, 116*d*, 116*e*, 116*f*, 116*g*, collectively referred to 116 hereinafter similar to the blister manufacturing system (not shown). The cartoning section 100 processes a plurality of cartons 114 and helps in cartoning the plurality of blister leaflets 110 in the plurality of cartons 114 simultaneously. The plurality of blister leaflets 110 and the plurality of cartons 114 are processed at the plurality of processing stations 116 for the cartoning. The cartoning section 100 includes a conveyor belt 106, a plurality of processing stations 116, and a plurality of shuttles 104. The conveyor belt 106 is adapted to convey the plurality of cartons 114 and the plurality of blister leaflets 110 thereon, to the plurality of processing stations 116. In one example, the conveyor belt 106 may include magnetic guide rails.

In one embodiment, the plurality of processing stations 116 includes a carton loading station 116*a*, a blister loading station 116*g*, a first side flap closing station 116*b*, a pusher station 116*c*, an embossing station 116*d*, a second side flap closing station 116*e*, and a closing station 116*f*. The plurality of processing stations 116 is located on the conveyor belt 106. Each of the plurality of processing stations 116 is adapted to process the plurality of cartons 114 and insert the plurality of blister leaflets 110 into the plurality of cartons 114. The processing of the cartons 114 and the insertion of the blister leaflets 110 into the cartons 114 takes place simultaneously, which saves time and helps in making the cartoning section 100 compact, without the need of having a separate carton processing section and a blister packing section.

Figure 1B:
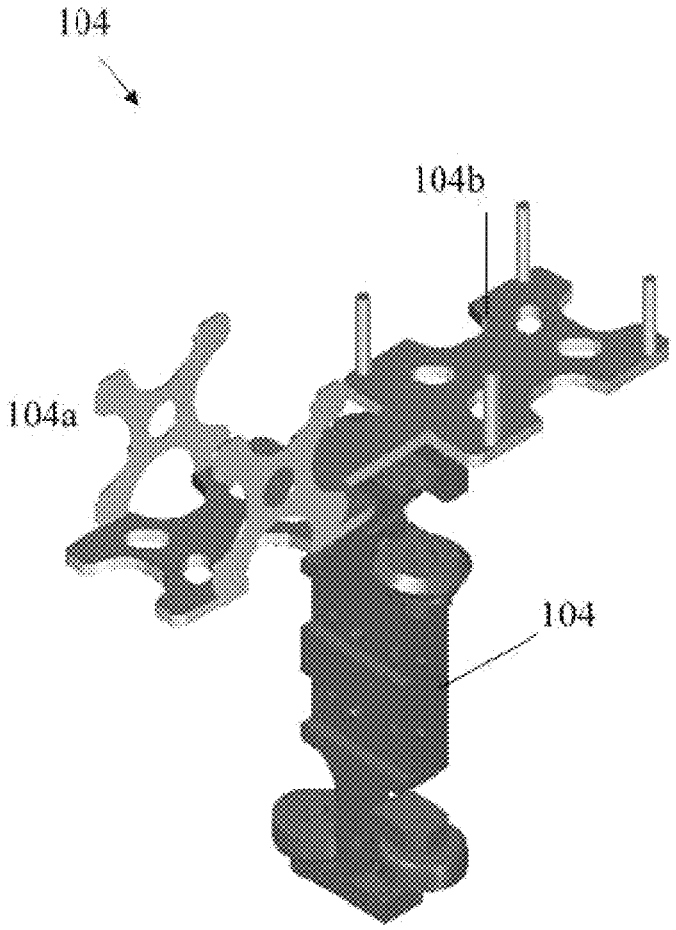
FIG. 1B illustrates a dual pocket shuttle, according to an embodiment of the present disclosure.

The simultaneous processing of the cartons 114 and the insertion of blister leaflets 110 into the plurality of cartons 114 will now be explained in detail with reference to FIG. 1. The plurality of shuttles 104 is adapted to carry at least one of a blister leaflet 110 and a carton 114 on them. In an embodiment, each of the plurality of shuttles 104 may include a carton pocket 104*b* and a leaflet pocket 104*a*, as shown in FIG. 1B. The carton pocket 104*b* is adapted to hold the carton 114, and the leaflet pocket 104*a* is adapted to hold the plurality of blister leaflets 110. The blister loading station 116*g* works parallelly with the carton loading station 116*a*. In one embodiment, the carton loading station 116*a* may be provided parallelly to the blister and leaflet loading station 116*g* and is adapted to load a carton 114 onto a carton pocket 104*b* of the shuttle 104. Now, as the shuttle 104 moves further, it carries the carton 114 and the blister leaflets 110 together through subsequent stations.

The plurality of shuttles 104 is adapted to be guided on the conveyor belt 106 to pass through the plurality of processing stations 116 for processing the plurality of cartons 114 and inserting the plurality of blister leaflets into the plurality of cartons 114. Firstly, the plurality of blister leaflets 110 and carton 114 is loaded onto the shuttle 104 for further processing. The carton loading station 116*a* is adapted to load the carton 114 onto the carton pocket 104*b* in the shuttle 104. The blister loading station 116*g* is located downstream to the carton loading station 116*a* and is adapted to load the plurality of blister leaflets 110 onto the blister pocket 104*a*.

The plurality of shuttles 104 has a broad design to hold a variety of cartons 114 or blister leaflets 110, or both. The dual pocket design of the shuttle 104 helps in reducing the material to be used for manufacturing separate shuttles 104 for carton 114 and blister leaflets 110. This helps in the reduction of material costs and maintenance costs too. Also, the footprint due to the present system is less compared to the conventional blister cartoning systems. The shuttle 104 changeover is also easy at the time of change of blister leaflet stocks. Unlike the conventional systems, the present cartoning section 100 carries both the blister leaflets 110 and the carton 114 via one single track i.e., the conveyor belt 106, due to the simultaneous feeding and packaging processes.

Once the blister leaflets 110 and carton 114 are loaded onto the shuttle 104, at least one side flap of the carton 114 is required to be closed, so that the blister leaflets 110 do not fall out of the carton 114 once inserted into the carton 114. The first side flap closing station 116*b* is located downstream to the blister loading station 116*g* and is adapted to close the first side flap (not shown) of the carton 114. Once the first side flap is closed, the carton 114 is filled with the plurality of blister leaflets 110. For the same, the shuttle 104 moves to the pusher station 116*c* with help of the conveyor belt 106. The pusher station 116*c* is located downstream to the first side flap closing station 116*b*. The pusher station 116*c* is adapted to push the plurality of blister leaflets 110 from the blister pocket carrying the plurality of blister leaflets 110 into the carton 114 present in the carton pocket 104*b* of the shuttle 104, with help of a pusher 112.

Once the blister leaflets 110 are filled into the carton 114, the type of blister leaflets 110 present in the carton 114 is required to be identified on the carton 114 in which the blister leaflets 110 are filled. One way for such identification may be embossing the filled cartons 114. For embossing, the filled carton 114 is transferred to the embossing station 116*d* by the shuttle 104 with help of the conveyor belt 106. The embossing station 116*d* is located downstream to the pusher station 116*b* and is adapted to emboss on the carton 114. Once the embossing is complete, the shuttle 104 carries the filled carton 114 to second the flap closing station 116*e*. The second flap closing station 116*e* is located downstream to the embossing station 116*d* and is adapted to close remaining side flaps of the filled carton 114. The shuttle 104 carries the filled carton 114 to the closing station 116*f*, thereafter. The closing station 116*f* is located downstream to the second flap closing station 116*e* and is adapted to tuck in at least one side of the carton 114 containing the plurality of blister leaflets 110. The packaged filled carton 114 finally exits from the cartoning section 100 with help of the shuttle 104 and conveyor belt 106, supported by a transfer system (not shown).

Figure 2A:
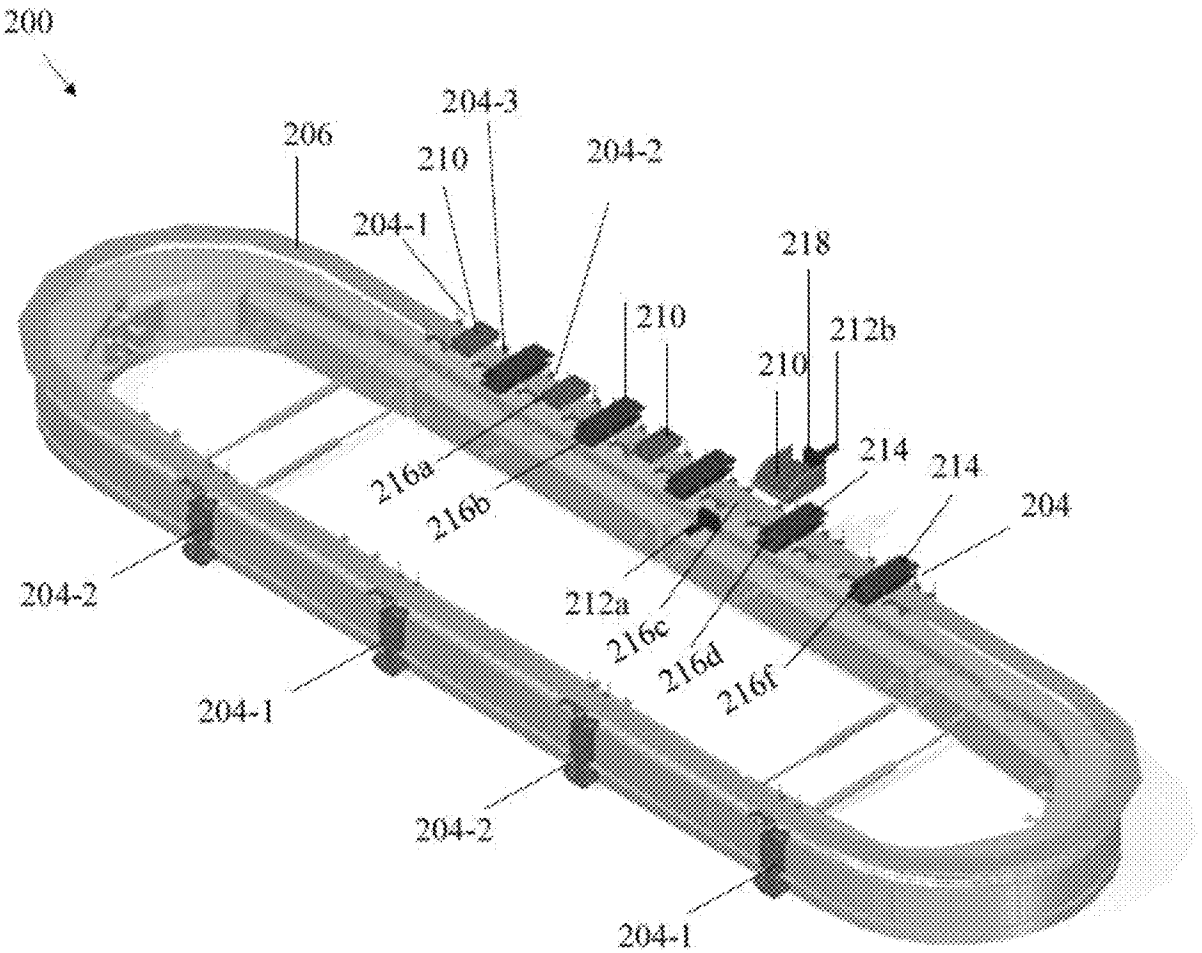
FIG. 2A illustrates a cartoning section with single pocket shuttles, according to another embodiment of the present disclosure.
Figure 2B:
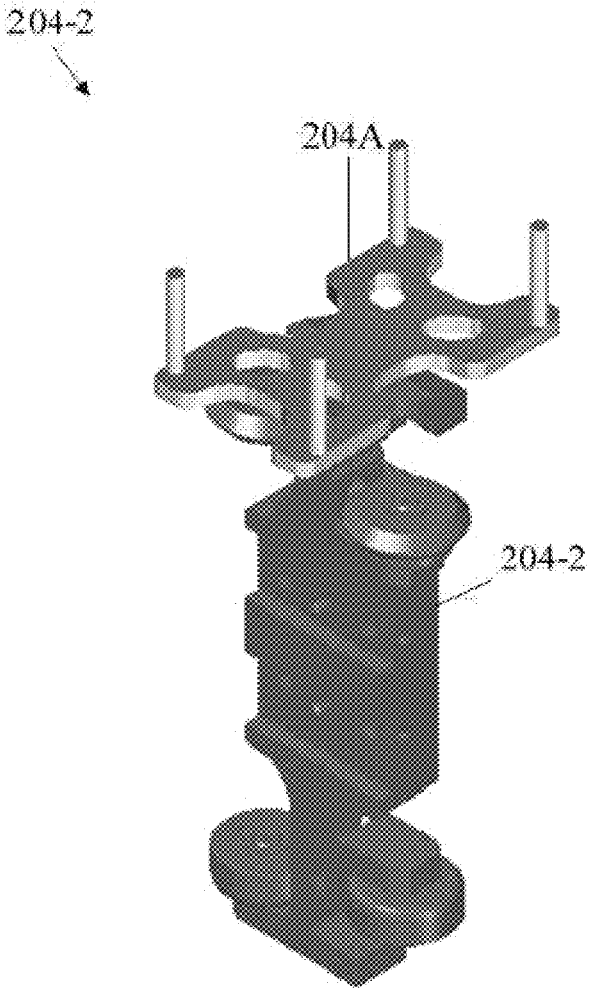
FIG. 2B illustrates a single pocket shuttle, according to an embodiment of the present disclosure.

In another embodiment, the plurality of shuttles may include a set of three shuttles including a first shuttle 204-1, a second shuttle 204-2, and a third shuttle 204-3. Each of the shuttles 204-1, 204-2, and 204-3 has a single pocket, as shown in FIG. 2B. The single pocket is adapted to carry either one of the cartons 214 or the blister leaflets 210. Out of these, the first shuttle 204-1 may be adapted to carry the plurality of blister leaflets 210 in its slot (not shown) whereas the second shuttle 204-2 may be adapted to carry the carton 214 in its slot 204A, as shown in FIG. 2. FIG. 2 illustrates a cartoning section 200 having a set of three shuttles, and the cartons and blister leaflets adapted to be placed in the shuttles 204-1, 204-2. The first shuttle 204-1 and the second shuttle 204-2 of the cartoning section 200 may be placed alternatively to each other on conveyor belt 206. The third shuttle 204-3 is placed between the first shuttle 204-1 and the second shuttle 204-2. The third shuttle 204-3 is adapted to support the first shuttle 204-1 and the second shuttle 204-2 carrying the blister leaflets 210 and the carton 214 respectively.

The set of three shuttles 204-1, 204-2, and 204-3 are adapted to be conveyed on the conveyor belt 206, thereby conveying the plurality of cartons 214 and the plurality of blister leaflets 210 thereon, to the plurality of processing stations 216*a*, 216*b*, 216*c*, 216*d*, 216*e*, 216*f*, 216*g*, collectively referred to as 216 hereinafter. The first shuttle 204-1 and the second shuttle 204-2, are first loaded on the plurality of blister leaflets 210 and the carton 214 respectively. Similar to FIG. 1, the plurality of processing stations 216 are present on the conveyor belt 206. The plurality of processing stations 216 include a blister loading station 216*a*, a carton loading station 216*b*, a pusher station 216*c*, an embossing station 216*d*, and a closing station 216*f*. The blister loading station 216*a* adapted to load the plurality of blister leaflets 210 onto the first shuttle 204-1. The carton loading station 216*b* is located downstream to the blister loading station 216*a* and is adapted to load the carton 214 onto the second shuttle 204-2, wherein the carton loading station 216*b* works parallelly with the blister loading station 216*a*.

Now, as the set of three shuttles 204-1, 204-2, and 204-3 move further, the shuttles 204-1, 204-2 carry the carton 214 and the blister leaflets 210 alternatively through further stations 216. The pusher station 216*c* is located downstream to the carton loading station 216*b* and includes a feeder 218, a first pusher 212*a*, and a second pusher 212*b*. The feeder 218 is positioned parallelly between the first pusher 212*a* and the second pusher 212*b*. Once the first shuttle 204-1 reaches the pusher station 216*c*, the first pusher 212*a* pushes the plurality of blister leaflets 210 from the first shuttle 204-1 into the feeder 218. The first shuttle 204-1 moves forward, and the second shuttle 204-2 now reaches the pusher station 216*c*. The second pusher 212*b* now pushes the plurality of blister leaflets 210 from the feeder into the carton 214 on the second shuttle 204-2. The embossing station 216*d* is located downstream to the pusher station 216*c* and is adapted to emboss on the carton 214 containing the plurality of blister leaflets 210. The closing station 216*f* is located downstream to the embossing station 216*d* and is adapted to close flaps (not shown) of the carton 214 carrying the plurality of blister leaflets 210.

After this, the packaged filled carton 214 finally exits from the cartoning section 200 with help of the first shuttle 204-1 and the second shuttle 204-2, and the conveyor belt 206. This arrangement of shuttles 204-1, 204-2 helps in curbing vibrations, as the shuttles 204-1, 204-2 carry less weight on them. Fewer vibration curbs more noise, and the simpler design ensures easy maintenance. Further, the slots provided on the shuttles 204-1, 204-2 are auto-adjustable as per the size of the leaflets and the carton 214. Therefore, there is no requirement of changing the slots on the shuttles 204-1, 204-2, 204-3 every time while loading different-sized blister leaflets 210 or cartons 214.

Figure 3:
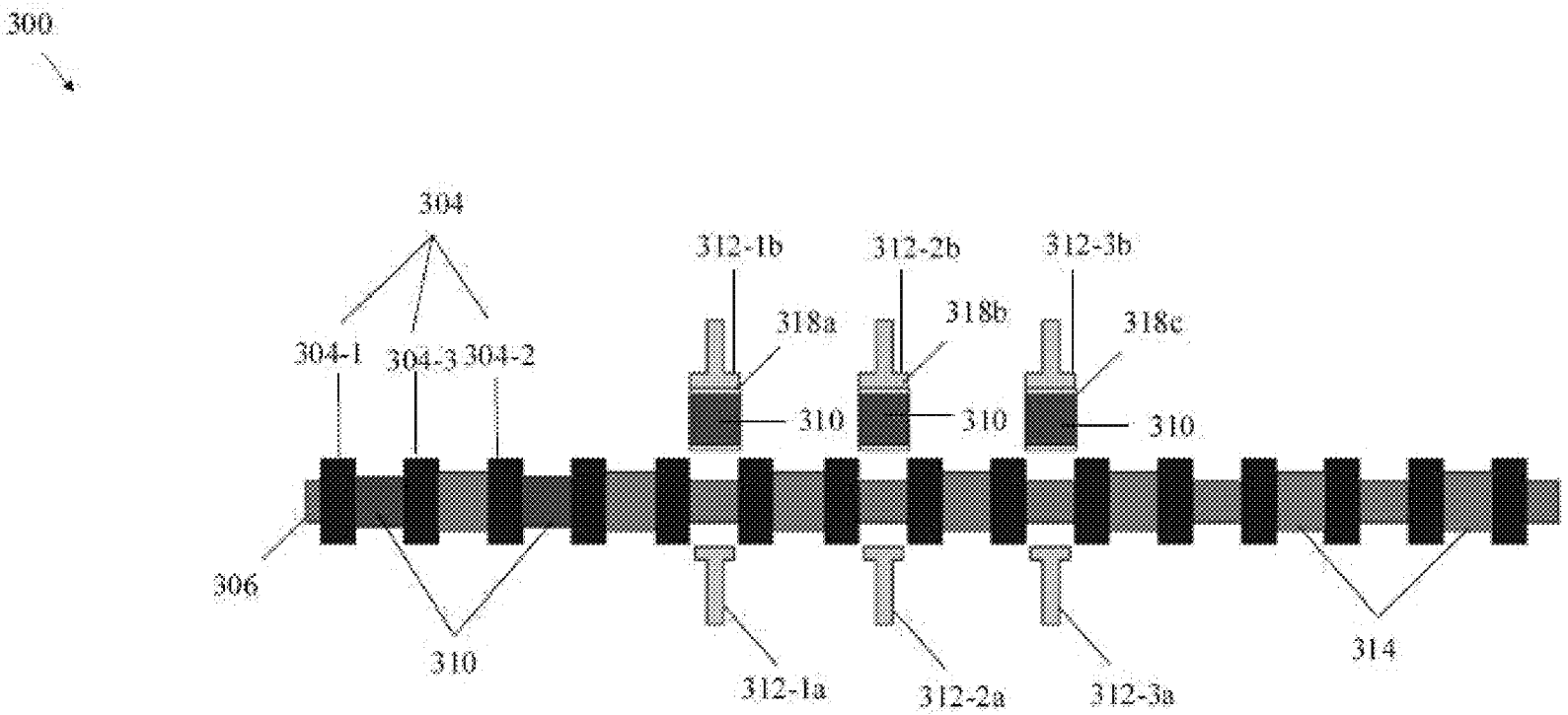
FIG. 3 illustrates a cartoning section with no pocket shuttles, according to another embodiment of the present disclosure.

In one embodiment, the plurality of cartons 314 and the plurality of blister leaflets 310 are placed between the plurality of shuttles 304 alternately, as shown in FIG. 3. Specifically, FIG. 3 depicts a cartoning section 300, wherein blister leaflets 310 and cartons 314 are placed between a plurality of shuttles 304. The shuttles 304 in such a case are adapted to push the blister leaflets 310 and the carton 314 forward towards proceeding stations. The blister leaflets 310 and the carton 314 are alternatively placed. Multiple first pushers 312-1*a*, 312-2*a*, 312-3*a* and second pushers 312-1*b*, 312-2*b*, 312-3*b* may be installed into the cartoning section 300, and the first pushers 312-1*a*, 312-2*a*, 312-3*a* in such a case are adjacent to the conveyor belt 306 and not the shuttle 304 and are adapted to push the blister leaflets 310 into a feeder. In this way, the blister leaflets 310 are pushed into a feeder 318*a*, 318*b*, 318*c* across the conveyor belt 306, and from between the shuttles 304. The feeder 318*a*, 318*b*, 318*c* is adapted to feed the blister leaflets 310 into the carton 314 with help of the second pushers 312*b* placed next to the feeder 318*a*, 318*b*, 318*c*, when the carton 314 reaches in front of a feeder 318*a*, 318*b*, 318*c*. However, the stations and their processes remain the same as explained previously. This placement of carton 314 and blister leaflets 310 between the shuttles 304 helps in further curbing vibrations, as the shuttles 304 are not carrying any weight on them. Therefore, the noise is further curbed, and the arrangement is even simpler, thereby ensuring easier maintenance.

Figure 4:
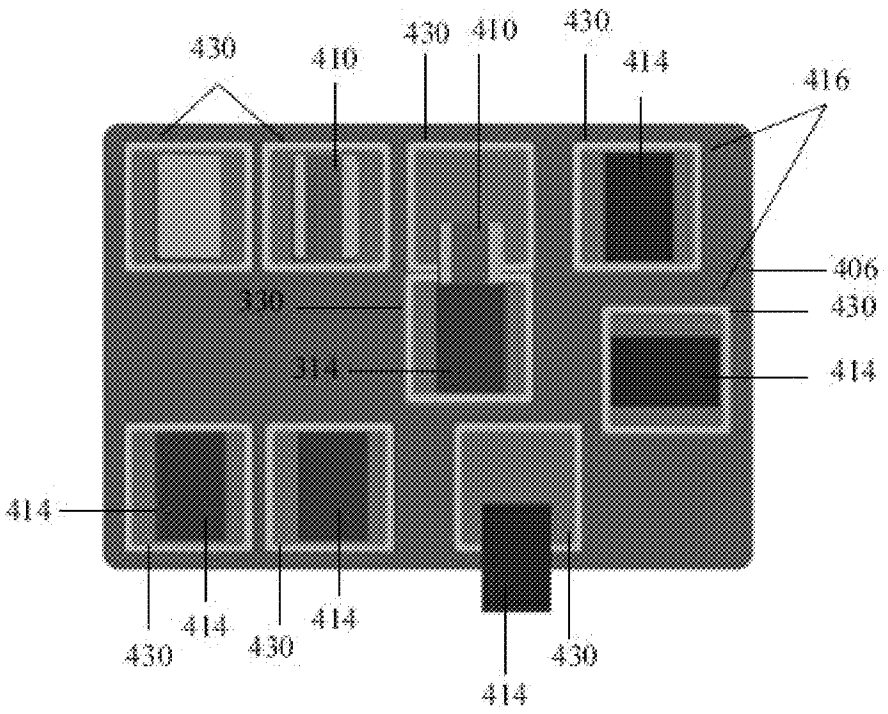
FIG. 4 illustrates a cartoning section with a random arrangement of stations on a planar motor, according to yet another embodiment of the present disclosure.

In one embodiment, the processing stations 416 may be arranged randomly, on a planar motor 406, as shown in FIG. 4. FIG. 4 depicts a top view of a cartoning section 400, which has a planar motor 406 as its base, instead of a conveyor belt 106, 206, 306. In this scenario, the movement of shuttles is of an asynchronous nature. The shuttles are adapted to levitate on the planar motor 406. The cartons 414 and blister leaflets 410 are placed in holders 430 on shuttles (not shown) placed on the planar motor 406, which carry the carton 414 and the blister leaflets 410 to different stations 416 (whereon the shuttles are placed) with the movement of the planar motor 406, for feeding the blister leaflets 410 into the carton 414 with the help of pushers (not shown). Then the carton 414 is sealed, embossed, etc., the processing stations being similar in structure and function as explained with respect to FIG. 1. The motion of the shuttles on the planar motor 406 in such a case may be asynchronous, and movement occurs selectively based on the progress in cartoning of the blister leaflets 410, and the location of next station 416. The advantage of planar motor 406 is that the shuttles may return to any station at any point during the cartoning cycle. Further, the planar motor 406 and the shuttles do away with the need for a conveyor belt 106, 206, 306 for conveying the cartons 414 and the blister leaflets 410 to the plurality of stations, as in the previous embodiments.

The cartoning section 100, 200, 300, 400 disclosed herein includes the blister manufacturing section and cartoning section 100, 200, 300, 400 which functions simultaneously with the blister manufacturing section. This helps in providing a compact and high-speed blister manufacturing and cartoning system. The blister manufacturing and cartoning system is easy to install and maintain due to its less complex nature, thereby having low maintenance costs and being more operator friendly.

While specific language has been used to describe the present disclosure, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

What is claimed is:

1. A loading assembly for a packaging system, comprising:

a cartoning section (100) for processing a plurality of cartons (114) and cartoning a plurality of blister leaflets (110) in the plurality of cartons (114) simultaneously, wherein the cartoning section (100) comprises:

a conveyor belt (106) adapted to convey the plurality of cartons (114) and the plurality of blister leaflets (110) thereon;

a plurality of processing stations (116*a*, 116*b*, 116*c*, 116*d*, 116*e*, 116*f*, 116*g*) located on the conveyor belt (106), each of the plurality of processing stations (116*a*, 116*b*, 116*c*, 116*d*, 116*e*, 116*f*, 116*g*) adapted to process the plurality of cartons (114) and insert the plurality of blister leaflets (110) into the plurality of cartons (114); and a plurality of shuttles (104) adapted to carry at least one of a blister leaflet (110) and a carton (114) of the plurality of cartons (114), the plurality of shuttles (104) adapted to be guided on the conveyor belt (106) to pass through the plurality of processing stations (116*a*, 116*b*, 116*c*, 116*d*, 116*e*, 116*f*, 116*g*) for processing the plurality of cartons (114) and inserting the plurality of blister leaflets (110) into the plurality of cartons (114), wherein the plurality of shuttles includes:

a carton pocket (104*b*) configured to hold the carton (114); and a blister pocket (104*a*) configured to hold the plurality of blister leaflets (110).

2. The loading assembly as claimed in claim 1, wherein the plurality of processing stations (116*a*, 116*b*, 116*c*, 116*d*, 116*e*, 116*f*, 116*g*) comprises:

a carton loading station (116*a*) adapted to load the carton (114) onto the carton pocket (104*b*) in the shuttle (104);

a blister loading station (116*g*) located downstream to the carton loading station (116*a*), and adapted to load the plurality of blister leaflets (110) onto the blister pocket (104*a*), wherein the blister loading station (116*g*) works parallelly with the carton loading station (116*a*);

a first side flap closing station (116*b*) located downstream to the blister loading station (116*g*), the first side flap closing station (116*b*) adapted to close a first side flap of the carton (114);

a pusher station (116*c*) located downstream to the first side flap closing station (116*b*), the pusher station (116*c*) adapted to push the plurality of blister leaflets (110) from the blister pocket (104*a*) carrying the plurality of blister leaflets (110) into the carton (114), with help of a pusher (112);

an embossing station (116*d*) located downstream to the pusher station (116*c*), the embossing station (116*d*) adapted to emboss on the carton (114); and a second flap closing station (116*e*) located downstream to the embossing station (116*d*), the second flap closing station (116*d*) adapted to close remaining side flaps of the carton (114); and a closing station (116*f*) located downstream to the second flap closing station (116*e*), the closing station (116*f*) adapted to tuck in at least one side of the carton (114) containing the plurality of blister leaflets (110).

3. The loading assembly as claimed in claim 1, wherein the plurality of shuttles includes a set of three shuttles (204-1, 204-2, 204-3) having:

a first shuttle (204-1) adapted to carry the plurality of blister leaflets (210), a second shuttle (204-2) adapted to carry the carton (214); and a third shuttle (204-3) between the first shuttle (204-1) and the second shuttle (204-2), the third shuttle (204-3) adapted to support the first shuttle (204-1) and the second shuttle (204-2).

4. The loading assembly as claimed in claim 3, wherein the plurality of processing stations (216*a*, 216*b*, 216*c*, 216*d*, 216*e*, 216*f*) comprises:

a blister loading station (216*a*) adapted to load the plurality of blister leaflets (210) onto the first shuttle;

a carton loading station (216*b*) located downstream to the blister loading station (216*a*), the carton loading station (216*b*) adapted to load the carton (214) onto the second shuttle (204-2), wherein the carton loading station (216*b*) works parallelly with the blister loading station (216*b*);

a pusher station (216*c*) located downstream to the carton loading station (216*b*), the pusher station (216*c*) comprising:

a feeder (218) positioned parallelly between a first pusher (212*a*) and a second pusher (212*b*), wherein:

the first pusher (212*a*) is adapted to push the plurality of blister leaflets (110) from the first shuttle (204-1) into the feeder (218), and the second pusher (212*b*) is adapted to push the plurality of blister leaflets (110) from the feeder (218) into the carton (114) on the second shuttle (204-2));

an embossing station (216*d*) located downstream to the pusher station (216*c*), the embossing station (216*d*) adapted to emboss on the carton (214) containing the plurality of blister leaflets (210); and a closing station (216*f*) located downstream to the embossing station (216*d*), the closing station adapted to close flaps of the carton (114) carrying the plurality of blister leaflets (110).

5. The loading assembly as claimed in claim 1, comprising a cartoning section (300), wherein the plurality of cartons (314) and the plurality of blister leaflets (310) are placed between the plurality of shuttles (304) alternately.

6. The loading assembly as claimed in claim 5, wherein the cartoning section (300) comprises:

a blister loading station adapted to load the plurality of blister leaflets (310) between a first shuttle (304-1) and a third shuttle (304-3) of the plurality of shuttles (304);

a carton loading station located downstream to the blister loading station, the blister loading station adapted to load the carton (314) between a second shuttle (304-2) and the third shuttle (304-3) of the plurality of shuttles (304), wherein the carton loading station works parallelly with the blister loading station; and at least one pusher station located downstream to the carton loading station, the pusher station comprising:

at least one feeder (318*a*, 318*b*, 318*c*) positioned parallelly between the plurality of shuttles (304), wherein the at least one feeder (318*a*, 318*b*, 318*c*) is adapted to:

push the plurality of blister leaflets (310) from between the first shuttle (304-1) and the third shuttle (304-3) into the at least one feeder (318*a*, 318*b*, 318*c*), and push the plurality of blister leaflets (310) from the feeder into the carton (314) placed between the second shuttle (304-2) and the third shuttle (304-3).

7. A loading assembly for a packaging system, comprising:

a cartoning section (400) for processing a plurality of cartons (414) and cartoning a plurality of blister leaflets (410) in the plurality of cartons (414) simultaneously, wherein the cartoning section (400) comprises:

a planar motor (406) adapted to convey the plurality of cartons (414) and the plurality of blister leaflets (410) thereon;

a plurality of processing stations (416) located randomly on the planar motor (406), each of the plurality of processing stations (416) adapted to perform a preassigned task for processing the plurality of cartons (414) and inserting the plurality of blister leaflets into the plurality of cartons (414); and a plurality of shuttles (430) adapted to carry at least one of a blister leaflet and a carton (414), the plurality of shuttles adapted to be guided on the planar motor (406) to pass through the plurality of processing stations for inserting the plurality of blister leaflets (410) into the carton (414) and closing the carton (414) thereafter, wherein each of the plurality of shuttles (430) includes:

a carton pocket adapted to hold the carton (414); and a blister pocket adapted to hold the plurality of blister leaflets (410).

8. The loading assembly as claimed in claim 7, wherein the plurality of processing stations comprises:

a carton loading station adapted to load the carton (414) onto at least one of the plurality of shuttles;

a blister loading station adapted to load the plurality of blister leaflets (410) onto at least one of the plurality of shuttles, wherein the blister loading station works parallelly with the carton loading station;

a first side flap closing station adapted to close a first side flap of the carton (414);

a pusher station adapted to push the plurality of blister leaflets (410) from the shuttle (430) carrying the plurality of blister leaflets (410) into the carton (414), with help of a pusher;

an embossing station adapted to emboss on the carton (414); and a second flap closing station adapted to close remaining side flaps of the carton (414); and a closing station adapted to tuck in at least one side of the carton (414) containing the plurality of blister leaflets (410).

9. A blister manufacturing and packaging system comprising:

a blister manufacturing section adapted to manufacture a plurality of blister leaflets (110);

a cartoning section (100) located downstream to the blister manufacturing section, and adapted to process a plurality of cartons (114) and cartoning a plurality of blister leaflets (110) in the plurality of cartons (114) simultaneously, wherein the cartoning section (100) comprises:

a conveyor belt (106) adapted to convey the plurality of cartons (114) and the plurality of blister leaflets (110) thereon; a plurality of processing stations (116*a*, 116*b*, 116*c*, 116*d*, 116*e*, 116*f*, 116*g*) located on the conveyor belt (106), each of the plurality of processing stations (116*a*, 116*b*, 116*c*, 116*d*, 116*e*, 116*f*, 116*g*) adapted to process the plurality of cartons (114) and insert the plurality of blister leaflets (110) into the plurality of cartons (114); and a plurality of shuttles (104) adapted to carry at least one of a blister leaflet (110) and a carton (114), the plurality of shuttles (104) adapted to be guided on the conveyor belt (106) to pass through the plurality of processing stations (116*a*, 116*b*, 116*c*, 116*d*, 116*e*, 116*f*, 116*g*) for processing the plurality of cartons (114) and inserting the plurality of blister leaflets (110) into the plurality of cartons (114), wherein each of the plurality of shuttles (430) includes:

a carton pocket adapted to hold the carton (414); and a blister pocket adapted to hold the plurality of blister leaflets (410).

* * * * *